US008272996B2

(12) United States Patent
Weier

(10) Patent No.: US 8,272,996 B2
(45) Date of Patent: Sep. 25, 2012

(54) DEVICE AND METHOD FOR LIMITING TRAVEL IN AN EXERCISE DEVICE, AND AN EXERCISE DEVICE INCLUDING SUCH A LIMITING DEVICE

(75) Inventor: Keith M. Weier, Poway, CA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 13/050,704

(22) Filed: Mar. 17, 2011

(65) Prior Publication Data

US 2011/0256988 A1 Oct. 20, 2011

Related U.S. Application Data

(63) Continuation of application No. 12/057,964, filed on Mar. 28, 2008, now abandoned.

(60) Provisional application No. 60/909,027, filed on Mar. 30, 2007.

(51) Int. Cl.
*A63B 22/04* (2006.01)
*A63B 22/06* (2006.01)

(52) U.S. Cl. ..... 482/52; 482/54

(58) Field of Classification Search ..... 482/51–54, 482/148, 908, 112
See application file for complete search history.

(56) References Cited

U.S. PATENT DOCUMENTS

| | | | | |
|---|---|---|---|---|
| 347,101 | A | | 8/1886 | Ferry |
| 834,461 | A | | 10/1906 | Fair |
| 964,898 | A | | 7/1910 | Budingen |
| 1,082,940 | A | | 12/1913 | Flora |
| 1,652,102 | A | | 12/1927 | Elmer et al. |
| 2,017,128 | A | | 10/1935 | O'Neill, Jr. |
| 2,037,492 | A | * | 4/1936 | Arnold ..... 137/625.24 |
| 2,117,957 | A | | 5/1938 | Heller |
| 2,512,904 | A | | 6/1950 | Strelecky |
| 2,538,980 | A | * | 1/1951 | Payne, Jr. ..... 49/280 |
| 2,661,973 | A | | 12/1953 | Sweger |
| 2,941,834 | A | | 6/1960 | Appleton et al. |
| 3,408,067 | A | | 10/1968 | Armstrong |
| 3,437,180 | A | * | 4/1969 | Natschke et al. ..... 188/202 |
| 3,464,601 | A | * | 9/1969 | Christensen ..... 223/46 |
| 3,512,619 | A | * | 5/1970 | Rauglas ..... 188/202 |
| 3,580,340 | A | | 5/1971 | Brown |
| 3,637,206 | A | | 1/1972 | Chickering, III |
| 3,642,279 | A | | 2/1972 | Cutter |
| 3,650,529 | A | | 3/1972 | Salm |
| 3,711,090 | A | | 1/1973 | Fiedler |

(Continued)

FOREIGN PATENT DOCUMENTS

CN 2510102 Y 9/2002

(Continued)

OTHER PUBLICATIONS

U.S. Appl. No. 13/372,750, filed Feb. 14, 2012, Piaget et al.

*Primary Examiner* — Stephen Crow
(74) *Attorney, Agent, or Firm* — Dorsey & Whitney LLP

(57) ABSTRACT

A method and/or a device may limit a distance traveled by a treadle assembly in an exercise device. For example, the distance traveled by the treadle assembly may be limited by limiting a distance that a resistance element operably coupled to the treadle assembly may travel. An exercise apparatus may include a travel-limiting device or capability.

14 Claims, 9 Drawing Sheets

U.S. PATENT DOCUMENTS

| | | | | | |
|---|---|---|---|---|---|
| 3,735,101 | A | | 5/1973 | Stewart | |
| 3,747,924 | A | * | 7/1973 | Champoux | 482/52 |
| 3,765,245 | A | | 10/1973 | Hampl | |
| 3,792,860 | A | | 2/1974 | Selnes | |
| 3,814,420 | A | * | 6/1974 | Encke | 482/130 |
| 3,826,491 | A | | 7/1974 | Elder | |
| 3,846,704 | A | | 11/1974 | Bessette | |
| 3,848,467 | A | | 11/1974 | Flavell | |
| 3,963,101 | A | * | 6/1976 | Stadelmann et al. | 188/300 |
| 3,966,182 | A | * | 6/1976 | Stadelmann et al. | 267/124 |
| 3,970,302 | A | | 7/1976 | McFee | |
| 4,063,726 | A | | 12/1977 | Wilson | |
| 4,066,257 | A | | 1/1978 | Moller | |
| 4,126,326 | A | | 11/1978 | Phillips | |
| 4,204,673 | A | * | 5/1980 | Speer, Sr. | 482/5 |
| 4,274,625 | A | | 6/1981 | Gaetano | |
| 4,323,237 | A | | 4/1982 | Jungerwirth | |
| 4,334,676 | A | | 6/1982 | Schonenberger | |
| 4,342,452 | A | | 8/1982 | Summa | |
| 4,344,616 | A | | 8/1982 | Ogden | |
| 4,347,993 | A | | 9/1982 | Leonard | |
| 4,358,105 | A | | 11/1982 | Sweeney, Jr. | |
| 4,374,587 | A | | 2/1983 | Ogden | |
| 4,406,451 | A | | 9/1983 | Gaetano | |
| 4,408,183 | A | | 10/1983 | Wills | |
| 4,423,864 | A | | 1/1984 | Wiik | |
| 4,426,077 | A | * | 1/1984 | Becker | 482/92 |
| 4,555,108 | A | | 11/1985 | Monteiro | |
| 4,563,001 | A | * | 1/1986 | Terauds | 482/53 |
| 4,659,074 | A | | 4/1987 | Taitel | |
| 4,659,077 | A | | 4/1987 | Stropkay | |
| 4,733,858 | A | | 3/1988 | Lan | |
| 4,747,612 | A | | 5/1988 | Kuhn | |
| 4,796,881 | A | * | 1/1989 | Watterson | 482/73 |
| 4,830,362 | A | * | 5/1989 | Bull | 482/53 |
| 4,838,543 | A | * | 6/1989 | Armstrong et al. | 482/53 |
| 4,842,268 | A | * | 6/1989 | Jenkins | 482/53 |
| 4,938,475 | A | | 7/1990 | Sargeant et al. | |
| 4,949,993 | A | | 8/1990 | Stark et al. | |
| 4,976,424 | A | | 12/1990 | Sargeant et al. | |
| 4,998,725 | A | | 3/1991 | Watterson et al. | |
| 5,020,794 | A | | 6/1991 | Englehardt et al. | |
| 5,039,088 | A | | 8/1991 | Shifferaw | |
| 5,048,821 | A | | 9/1991 | Kuo-Liang | |
| 5,054,770 | A | * | 10/1991 | Bull | 482/53 |
| 5,062,627 | A | * | 11/1991 | Bingham | 482/53 |
| 5,071,115 | A | * | 12/1991 | Welch | 482/53 |
| D326,491 | S | | 5/1992 | Dalebout | |
| 5,110,117 | A | | 5/1992 | Fisher et al. | |
| 5,117,170 | A | | 5/1992 | Keane et al. | |
| 5,129,873 | A | * | 7/1992 | Henderson et al. | 482/52 |
| 5,135,447 | A | | 8/1992 | Robards, Jr. | |
| 5,139,255 | A | | 8/1992 | Sollami | |
| 5,149,084 | A | | 9/1992 | Dalebout et al. | |
| 5,163,888 | A | | 11/1992 | Stearns | |
| 5,180,353 | A | * | 1/1993 | Snyderman | 482/111 |
| 5,188,577 | A | * | 2/1993 | Young et al. | 482/53 |
| 5,195,935 | A | | 3/1993 | Fencel | |
| 5,199,934 | A | | 4/1993 | Lin | |
| 5,207,621 | A | | 5/1993 | Koch et al. | |
| 5,226,866 | A | | 7/1993 | Engel et al. | |
| 5,238,462 | A | | 8/1993 | Cinke et al. | |
| 5,263,910 | A | | 11/1993 | Yang | |
| 5,267,923 | A | | 12/1993 | Piaget et al. | |
| 5,282,776 | A | | 2/1994 | Dalebout | |
| 5,299,993 | A | | 4/1994 | Habing | |
| 5,308,300 | A | | 5/1994 | Chino et al. | |
| 5,318,487 | A | | 6/1994 | Golen et al. | |
| 5,318,490 | A | * | 6/1994 | Henderson et al. | 482/53 |
| 5,320,588 | A | * | 6/1994 | Wanzer et al. | 482/53 |
| 5,336,142 | A | * | 8/1994 | Dalebout et al. | 482/52 |
| 5,336,146 | A | * | 8/1994 | Piaget et al. | 482/54 |
| 5,338,271 | A | * | 8/1994 | Wang | 482/52 |
| 5,338,273 | A | | 8/1994 | Metcalf | |
| 5,370,592 | A | | 12/1994 | Wu | |
| 5,372,559 | A | * | 12/1994 | Dalebout et al. | 482/54 |
| 5,372,560 | A | | 12/1994 | Chang | |
| 5,374,227 | A | | 12/1994 | Webb | |
| 5,385,520 | A | | 1/1995 | Lepine et al. | |
| 5,403,252 | A | | 4/1995 | Leon et al. | |
| 5,411,279 | A | | 5/1995 | Magid | |
| 5,431,612 | A | | 7/1995 | Holden | |
| 5,441,467 | A | | 8/1995 | Stevens | |
| 5,460,586 | A | | 10/1995 | Wilkinson et al. | |
| 5,490,818 | A | | 2/1996 | Haber et al. | |
| 5,492,517 | A | | 2/1996 | Bostic | |
| 5,512,025 | A | | 4/1996 | Dalebout et al. | |
| 5,518,470 | A | | 5/1996 | Piaget et al. | |
| 5,538,489 | A | | 7/1996 | Magid | |
| 5,575,740 | A | | 11/1996 | Piaget et al. | |
| 5,607,376 | A | | 3/1997 | Magid | |
| 5,622,527 | A | * | 4/1997 | Watterson et al. | 482/53 |
| 5,626,539 | A | * | 5/1997 | Piaget et al. | 482/54 |
| 5,643,144 | A | | 7/1997 | Trulaske | |
| 5,645,512 | A | * | 7/1997 | Yu | 482/53 |
| 5,669,856 | A | | 9/1997 | Liu | |
| 5,679,101 | A | | 10/1997 | Magid | |
| 5,690,582 | A | | 11/1997 | Ulrich et al. | |
| 5,702,323 | A | | 12/1997 | Poulton | |
| 5,749,807 | A | | 5/1998 | Webb | |
| 5,762,587 | A | * | 6/1998 | Dalebout et al. | 482/53 |
| 5,792,029 | A | * | 8/1998 | Gordon | 482/52 |
| 5,803,871 | A | | 9/1998 | Stearns et al. | |
| 5,803,874 | A | | 9/1998 | Wilkinson | |
| 5,803,880 | A | | 9/1998 | Allen | |
| 5,816,372 | A | | 10/1998 | Carlson | |
| 5,833,584 | A | | 11/1998 | Piaget et al. | |
| 5,871,421 | A | | 2/1999 | Trulaske et al. | |
| D406,621 | S | * | 3/1999 | Piaget | D21/669 |
| 5,879,271 | A | | 3/1999 | Stearns | |
| 5,882,281 | A | | 3/1999 | Stearns et al. | |
| 5,897,459 | A | * | 4/1999 | Habing et al. | 482/53 |
| 5,897,460 | A | | 4/1999 | McBride | |
| 5,897,461 | A | | 4/1999 | Socwell | |
| 5,913,384 | A | | 6/1999 | Williams | |
| 5,919,115 | A | | 7/1999 | Horowitz et al. | |
| D412,953 | S | | 8/1999 | Armstrong | |
| 5,951,449 | A | | 9/1999 | Oppriecht | |
| 5,967,944 | A | | 10/1999 | Vittone | |
| 5,993,358 | A | | 11/1999 | Gureghian et al. | |
| D421,779 | S | * | 3/2000 | Piaget et al. | D21/669 |
| 6,033,344 | A | | 3/2000 | Trulaske et al. | |
| 6,042,513 | A | | 3/2000 | Koteles et al. | |
| 6,042,519 | A | | 3/2000 | Shea | |
| 6,045,490 | A | | 4/2000 | Shafer et al. | |
| D424,137 | S | | 5/2000 | Barker et al. | |
| 6,113,518 | A | | 9/2000 | Maresh et al. | |
| 6,135,925 | A | | 10/2000 | Liu | |
| 6,152,859 | A | | 11/2000 | Stearns | |
| 6,179,754 | B1 | | 1/2001 | Wang et al. | |
| 6,217,487 | B1 | | 4/2001 | Reinert | |
| D445,152 | S | | 7/2001 | Wang et al. | |
| 6,258,012 | B1 | | 7/2001 | Yoshimura | |
| 6,264,042 | B1 | | 7/2001 | Cossey, Jr. et al. | |
| 6,283,896 | B1 | | 9/2001 | Grunfeld et al. | |
| D450,792 | S | | 11/2001 | Kuo | |
| 6,409,633 | B1 | | 6/2002 | Abelbeck | |
| 6,454,679 | B1 | | 9/2002 | Radow | |
| 6,461,279 | B1 | * | 10/2002 | Kuo | 482/54 |
| 6,554,749 | B2 | | 4/2003 | Lund et al. | |
| 6,626,802 | B1 | | 9/2003 | Rodgers, Jr. | |
| D482,085 | S | | 11/2003 | Eyler et al. | |
| 6,645,124 | B1 | | 11/2003 | Clem | |
| 6,672,994 | B1 | | 1/2004 | Stearns et al. | |
| 6,761,667 | B1 | | 7/2004 | Cutler et al. | |
| 6,811,517 | B1 | | 11/2004 | Eschenbach | |
| 6,811,519 | B2 | * | 11/2004 | Kuo | 482/54 |
| 6,824,502 | B1 | | 11/2004 | Huang | |
| 6,849,034 | B2 | | 2/2005 | Eschenbach | |
| 6,893,383 | B1 | | 5/2005 | Chang et al. | |
| 6,902,513 | B1 | | 6/2005 | McClure | |
| 6,923,745 | B2 | | 8/2005 | Stearns | |
| 6,923,746 | B1 | | 8/2005 | Skowronski et al. | |
| D521,577 | S | | 5/2006 | Wu | |
| D527,060 | S | * | 8/2006 | Flick et al. | D21/669 |
| 7,097,593 | B2 | * | 8/2006 | Chang | 482/54 |
| D534,973 | S | * | 1/2007 | Flick et al. | D21/669 |

| | | | | |
|---|---|---|---|---|
| 7,163,493 | B1 | 1/2007 | Kuo | |
| 7,166,062 | B1 | 1/2007 | Watterson | |
| 7,179,204 | B2 | 2/2007 | Anderson et al. | |
| D546,909 | S | 7/2007 | Flick | |
| 7,306,546 | B2 * | 12/2007 | Lo | 482/52 |
| 7,316,632 | B2 | 1/2008 | Rodgers | |
| 7,341,542 | B2 | 3/2008 | Ohrt et al. | |
| 7,377,882 | B2 | 5/2008 | Watterson et al. | |
| 7,517,303 | B2 | 4/2009 | Crawford | |
| 7,553,260 | B2 | 6/2009 | Piaget et al. | |
| 7,618,346 | B2 | 11/2009 | Crawford et al. | |
| 7,621,850 | B2 * | 11/2009 | Piaget et al. | 482/54 |
| 7,645,214 | B2 | 1/2010 | Lull | |
| 7,704,191 | B2 | 4/2010 | Smith et al. | |
| 7,731,636 | B2 | 6/2010 | Lull et al. | |
| D624,975 | S | 10/2010 | Flick et al. | |
| 7,811,209 | B2 | 10/2010 | Crawford et al. | |
| 7,815,549 | B2 | 10/2010 | Crawford et al. | |
| 7,819,779 | B2 | 10/2010 | Chang | |
| 8,002,674 | B2 | 8/2011 | Piaget et al. | |
| RE42,698 | E | 9/2011 | Kuo et al. | |
| 8,113,994 | B2 | 2/2012 | Piaget et al. | |
| 2001/0016542 | A1 * | 8/2001 | Yoshimura | 482/54 |
| 2001/0051564 | A1 | 12/2001 | Lund et al. | |
| 2003/0064862 | A1 | 4/2003 | Hald et al. | |
| 2004/0162193 | A1 | 8/2004 | Gray et al. | |
| 2004/0192514 | A1 * | 9/2004 | Piaget et al. | 482/54 |
| 2004/0209738 | A1 * | 10/2004 | Crawford et al. | 482/8 |
| 2004/0214693 | A1 | 10/2004 | Piaget et al. | |
| 2005/0202939 | A1 | 9/2005 | Lull et al. | |
| 2005/0209056 | A1 | 9/2005 | Daly et al. | |
| 2005/0209059 | A1 * | 9/2005 | Crawford et al. | 482/54 |
| 2005/0209060 | A1 * | 9/2005 | Lull | 482/54 |
| 2005/0209061 | A1 * | 9/2005 | Crawford et al. | 482/54 |
| 2005/0233864 | A1 * | 10/2005 | Smith et al. | 482/52 |
| 2005/0245359 | A1 | 11/2005 | Lo | |
| 2006/0223680 | A1 * | 10/2006 | Chang | 482/54 |
| 2008/0070758 | A1 * | 3/2008 | Lull et al. | 482/54 |
| 2009/0029831 | A1 | 1/2009 | Weier | |
| 2009/0176626 | A1 | 7/2009 | Crawford et al. | |
| 2009/0264260 | A1 | 10/2009 | Piaget et al. | |
| 2010/0062904 | A1 | 3/2010 | Crawford et al. | |
| 2010/0093500 | A1 | 4/2010 | Elbaz et al. | |
| 2011/0218079 | A1 | 9/2011 | Ohrt et al. | |
| 2011/0312472 | A1 | 12/2011 | Piaget et al. | |

FOREIGN PATENT DOCUMENTS

| | | | |
|---|---|---|---|
| CN | 2516185 | Y | 10/2002 |
| CN | 2675190 | Y | 2/2005 |
| EP | 1316332 | | 6/2003 |
| GB | 2184361 | | 6/1987 |
| TW | 472593 | U | 1/2002 |
| TW | 515306 | U | 12/2002 |
| TW | M249682 | U | 11/2004 |
| WO | 9516502 | A1 | 6/1995 |
| WO | 2004108225 | | 12/2004 |

* cited by examiner

DEVICE AND METHOD FOR LIMITING TRAVEL IN AN EXERCISE DEVICE, AND AN EXERCISE DEVICE INCLUDING SUCH A LIMITING DEVICE

CROSS-REFERENCE TO RELATED APPLICATION

This application is a continuation application of co-pending U.S. patent application Ser. No. 12/057,964, filed Mar. 28, 2008, and entitled "Device and Method For Limiting Travel in an Exercise Device, and an Exercise Device Including Such a Limiting Device", which claims the benefit under 35 U.S.C. §119(e) to U.S. Provisional Patent Application No. 60/909,027, filed Mar. 30, 2007, entitled "Device and Method For Limiting Travel in an Exercise Device, and an Exercise Device Including Such a Limiting Device", which are hereby incorporated by reference herein.

FIELD OF INVENTION

The present invention generally relates to exercise devices. In particular, the present invention relates to a combination treadmill and stair-climbing machine. More particularly, the present invention relates to limiting travel for such an exercise device.

BACKGROUND

Conventional combination treadmill and stair-climbing machines typically include a frame, a treadle assembly pivotally coupled to a base of the frame, and a resistance element coupled to the treadle assembly and an upright portion of the frame. The treadle assembly is configured to travel a distance in a generally upward direction and a generally downward direction relative to the base of the frame. A piston rod of the resistance element extends when the treadle assembly is in the upward direction. When the treadle assembly travels in the downward direction, the piston rod is retracted or pushed into the resistance element.

SUMMARY

There exists in the art a need for a device to manipulate or adjust the distance traveled by a treadle assembly in the upward and downward directions.

Embodiments may provide an exercise apparatus. The exercise apparatus may include: a frame; a treadle assembly operably coupled to the frame to travel in a first direction and a second direction that is opposite the first direction; a resistance device operably coupling the treadle assembly to the frame and configured to provide resistance as the treadle travels in the first direction and the second direction; and means for selectively limiting movement of the resistance device to thereby limit movement of the treadle assembly.

In embodiments, the frame may include a base and at least one upright extending substantially vertically from the base. In such embodiments, the resistance device may operably couple the treadle assembly to the at least one upright.

In embodiments, the treadle assembly may include a first treadle assembly and a second treadle assembly. The resistance device may include a first resistance element operably coupling the first treadle assembly to the frame and a second resistance element operably coupling the second treadle assembly to the frame. The means for selectively limiting movement of the resistance device may include means for selectively limiting movement of one of the first and second resistance elements to thereby limit movement of one of the first and second treadle assemblies. Alternatively or additionally, the means for selectively limiting movement of the resistance device may include means for selectively limiting movement of the first resistance element and means for selectively limiting movement of the second resistance element to thereby limit movement of the first and second treadle assemblies.

In embodiments, the resistance device may be configured to be movable between a maximum upper limit and a maximum lower limit. In such embodiments, the means for selectively limiting movement of the resistance device may be configured to set an upper limit for movement of the resistance device that is less than the maximum upper limit.

In embodiments, the means for selectively limiting movement of the resistance device may comprise a spacer or a plurality of spacers. Alternatively or additionally, the means for selectively limiting movement of the resistance device may comprise a bracket configured to engage the resistance device in a plurality of vertical positions.

Alternatively or additionally, the means for selectively limiting movement of the resistance device may comprise a movable bracket. In such embodiments, the means for selectively limiting movement of the resistance device may further comprise means for selectively moving the movable bracket. In embodiments, the means for selectively moving the movable bracket may comprises a gear assembly. Alternatively or additionally, the means for selectively moving the movable bracket may comprise a pair of pivoting links.

Embodiments may provide an exercise apparatus including: a treadle assembly configured to travel in an upward direction and a downward direction; and means for selectively adjusting a distance traveled by the treadle assembly in the upward and downward directions during operation of the exercise apparatus. In embodiments, the means for selectively adjusting a distance traveled by the treadle assembly may comprise at least one spacer. Alternatively or additionally, the means for selectively adjusting a distance traveled by the treadle assembly may comprises a bracket including a plurality of vertical positions. Alternatively or additionally, the means for selectively adjusting a distance traveled by the treadle assembly may comprise a movable bracket.

Embodiments may provide a method of selectively adjusting a distance traveled by a treadle assembly in an exercise apparatus. The method may comprise selectively positioning a means to determine a distance traveled by the treadle assembly in upward and downward directions during operation of the exercise apparatus. In embodiments, selectively positioning the means may comprise selectively limiting movement of a resistance device operably coupled to the treadle assembly.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following discussion provides a general structural framework for various embodiments of a dual treadmill exercise device having a travel-limiting device or means. Aspects of the present invention involve various structures that may be employed to support the travel-limiting device or means used on the exercise device.

Figure 1:
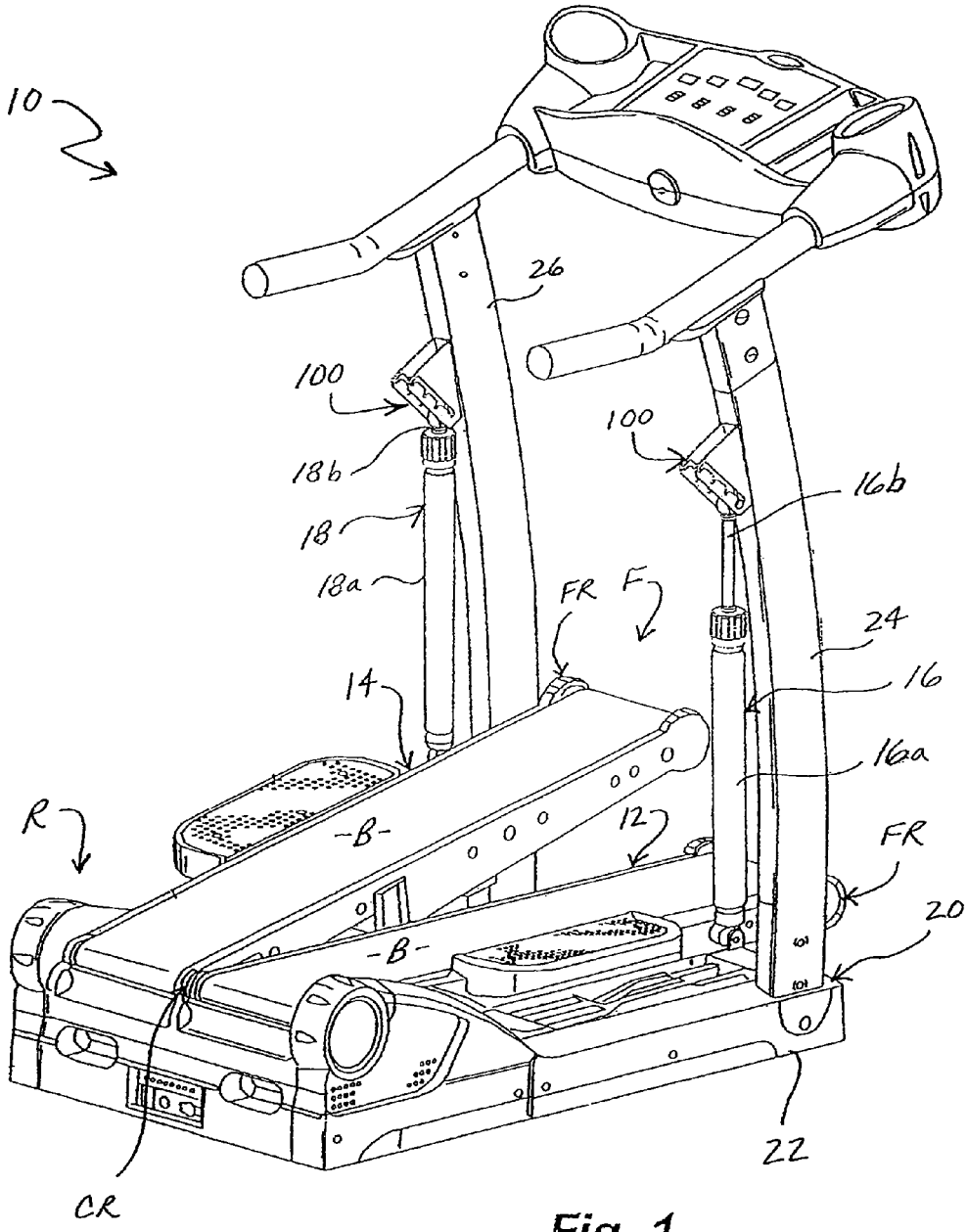
FIG. 1 is a perspective view of one example of an exercise device with a travel-limiting device.

With reference to FIG. 1 of the drawings, an exercise device may be configured to provide a user with a walking-type exercise, a stepping-type exercise, or a climbing-type exercise that is a combination of both walking and stepping. In general, the exercise device may include two treadmill-like assemblies (each referred to herein as a "treadle") pivotally connected with a frame so that the treadles may pivot upward and down about an axis. The axis may be a physical axis (axle) or may be a virtual axis defined by assemblies or components that support each treadle to pivot. Each treadle may be further coupled to the frame via one or more dampening or resistance elements, so that each treadle may travel in an upward direction and a down direction for a distance with respect to a lower frame portion or base. Operatively coupled to at least one of the resistance elements may be a travel-limiting device or means. The travel-limiting device or means may configured to adjust, manipulate, or alter a distance that may be traveled by the treadles, such that the distance is limited.

In use, a user may walk, jog, or run on the treadles. The treadles move by reciprocating in the upward and down directions about a treadle pivot axis while a belt or other tread surface moves along each treadle. The user may use the travel-limiting device to modify or manipulate the distance that may be traveled by the treadles in the upward and downward direction.

A maximum lower limit for movement of the treadles may be preset by a stop (not shown). For example, a stop may be disposed on each treadle that interacts with the frame, the floor or another stationary part. A maximum upper limit for movement of the treadles may be preset by a stop (not shown). For example, the stop limiting downward movement of one treadle may limit upward movement of the other treadle via a linkage (not shown) that links movement of the treadles in opposite directions. Thus, the resistance element may have a corresponding maximum lower limit and a maximum upper limit.

Movement of the resistance device may be limited by setting an upper limit that is less than its maximum upper limit using the travel-limiting device. This results in the upward movement of the treadle being limited to less than the maximum upper limit of the treadles. Various means for selectively limiting movement of the resistance device to thereby limit movement of the treadle assembly are disclosed herein. As will be understood in conjunction with the foregoing, such means may selectively limit movement of one of first and second resistance elements, when two resistance elements are employed, to thereby limit movement of at least that resistance element. Also, such means may comprise means for limiting movement of the first resistance element and means for limiting movement of the second resistance element.

Figure 2:
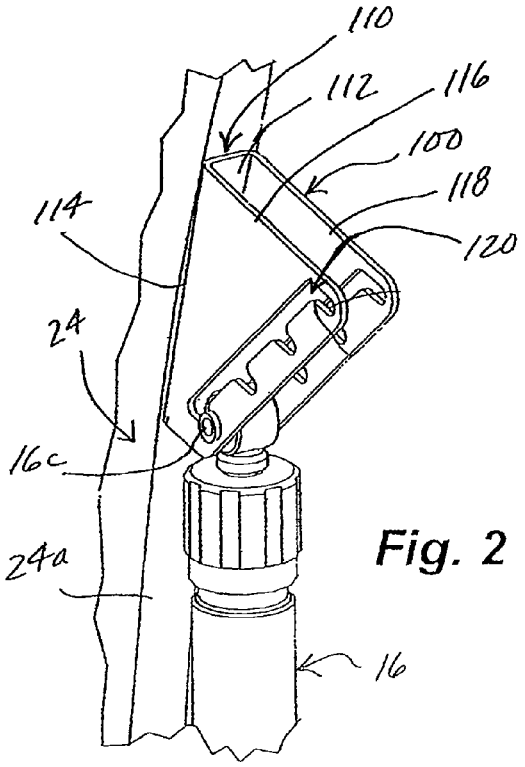
FIG. 2 is a perspective view of an upright bracket illustrated in FIG. 1 with a portion of an upright member of a frame and a piston rod of a resistance element in a first position of the upright bracket.
Figure 3:
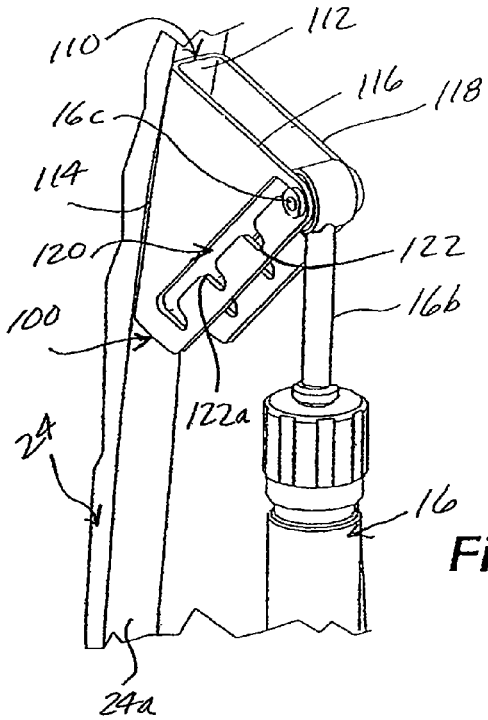
FIG. 3 is a perspective view of the upright bracket of FIG. 1 with the piston rod in a second position.
Figure 4:
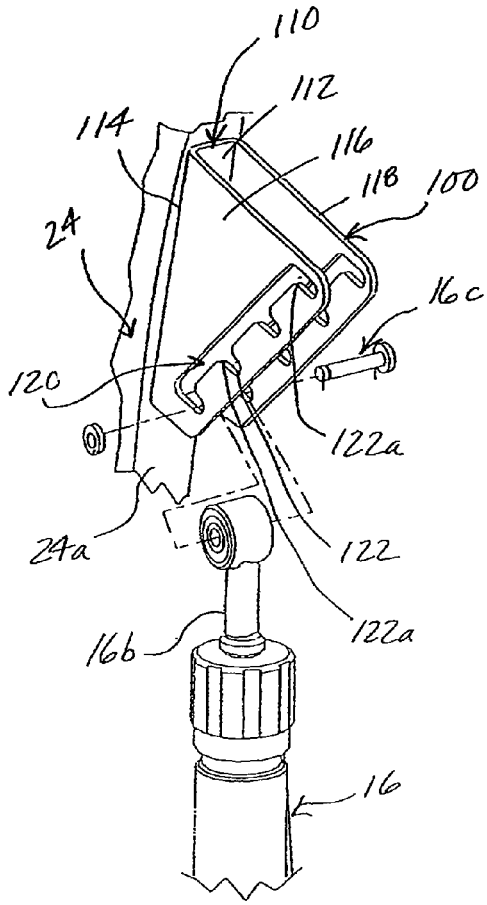
FIG. 4 is a partially exploded perspective view of the upright bracket with the piston rod in the first position.

FIG. 1 is a perspective view of one example of an exercise device 10. One embodiment of the exercise device 10 illustrated in FIG. 1 includes a travel-limiting device/means as an upright bracket, that is, a bracket coupled to an upright member, configured to engage with a piston rod of a resistance element in a first position. FIG. 2 is a perspective view of the upright bracket illustrated in FIG. 1 with only a portion of an upright member of a frame of the exercise device shown to better illustrate the upright bracket. FIG. 3 is a perspective view of the upright bracket of FIG. 2 with the piston rod in a different position of the upright bracket. FIG. 4 is a partially exploded perspective view of the upright bracket illustrated in FIG. 2.

Referring to FIG. 1, the exercise device 10 may include a frame 20, a first treadle assembly or treadle 12, a second treadle assembly or treadle 14, a first dampening or resistance device 16, a second or resistance dampening or resistance device 18, and a travel-limiting device/means 100. Each treadle 12, 14 may include a front portion F and a rear portion R. The rear portions of the treadles 12, 14 are supported above the frame 20 and are configured to reciprocate in a generally upward and downward manner during use. Each treadle 12, 14 also supports and endless belt or tread belt B that rotates over a deck and about a front roller FR and a common roller CR to provide either a forward or rearward moving surface.

The frame 20 provides general structural support for the moving components and other components of the exercise device 10. The frame 20 may be set directly on the floor or may be supported on adjustable legs, cushions, bumpers, wheels, or combinations thereof. The frame 20 may include a base portion 22, a first or right upright 24, and a second or left upright 26. The base portion 22 may include a forward end region and a rear end region, generally corresponding to the front F and rear R of the treadles 12, 14. The first upright 24 is connected with a right side of the forward end region of the base portion 22; likewise, the second upright 26 is connected to the left side of the forward region of the base portion 22. The uprights 24, 26 extend generally upwardly from the base portion 22, with a slight rearward sweep. As other configurations of the uprights are possible, it should be understood that the uprights need only extend generally vertically upward from the base of the frame, and may be perpendicular or angled as appropriate or desired. In general, each upright may comprise a substantially vertical post.

Each resistance device 16, 18 extends between each respective treadle 12, 14 and the respective upright 24, 26 of the frame 20 to support the front F of the treadles 12, 14 and to resist the downward movement of each treadle 12, 14. Each resistance device 16, 18 may be operably connected with the treadles 12, 14. As used herein the term "resistance device" is meant to include any device, structure, member, assembly, and configuration that resists movement, such as pivotal movement, of the treadles. The resistance provided by the resistance device may be constant, variable, and/or adjustable. Moreover, the resistance may be a function of load, of time, of heat, or of other factors. Such a resistance device may provide other functions, such as dampening downward, upward, or both downward and upward directions of movement by the treadles. The resistance device may also impart a return force on the treadles such that if the treadles are in a lower position, the resistance device may impart a return force to move the treadle upward; or, if the treadle is in an upper position, the resistance device may impart a return force to move the treadle downward.

The resistance device(s) 16, 18 may be arranged at various locations between the treadle(s) 12, 14 and the frame 20 of the exercise device 10. The resistance devices may extend between a left or outer frame member of the left treadle and the left upright frame member and/or a right or outer frame member of the right treadle and the right upright frame member. It should be understood that the movements of the treadles may be physically linked such that one resistance device operates for both treadles.

Generally, each resistance element 16, 18 may include a cylinder 16*a*, 18*a* filled with hydraulic fluid. A piston rod 16*b*, 18*b* extends outwardly from the cylinder. Within the respective cylinder, a piston (not shown) is connected with the respective piston rod. The piston defines at least one orifice (not shown) through which hydraulic fluid may flow, and may include a check valve (not shown). The piston subdivides the cylinder into two fluid filled chambers (not shown). During actuation of the resistance element, the piston either moves upward or down in the cylinder. In downward movement or extension of the resistance element, the fluid flows through the orifice at a rate governed partially by the number of orifices and the size of the orifices. One particular resistance element that may be used is shown and described in U.S. Pat. No. 5,762,587 titled "Exercise Machine With Adjustable-Resistance, Hydraulic Cylinder," the entire disclosure of which incorporated herein by reference.

As shown in FIG. 1, both the right resistance element 16 and the left resistance element 18 may include a treadle travel-limiting device/means 100; otherwise, only one of the resistance elements may be associated with a travel-limiting device/means. A right travel-limiting device/means 100 and a left travel-limiting device/means 100 may be substantially the same in structure and form; therefore, only a single travel-limiting device/means 100 and structures associated therewith will be discussed herein.

Referring to FIGS. 2-4, a travel limiting device/means as an upright bracket 100 couples the piston rod 16*b* of the right resistance element 16 to the first upright member 24. The upright bracket 100 allows a user to adjust the amount of the piston rod 16*b* that is extended or pulled out of the resistance element 16 when the right treadle 12 is in a lowest position. In other words, depending on the coupling position, the upright bracket 100 adjusts the amount of the piston rod 16*b* that is available for the resistance device 16 to travel upward. The upright bracket 100 thereby allows the distance that by the treadle 12 may travel upward to be adjusted.

The upright bracket 100 projects from a surface 24*a* of the upright member 24, and supports, holds and/or otherwise selectably engages the right resistance element 16 and thereby the treadle 12. The bracket 100 may include a substantially upright back wall 110 including a first surface 112 and a second surface 114. The second surface 114 is affixed to the upright member 24. A first plate 116 extends from the back wall 110, and a second plate 118 extends from the back wall 110 that is parallel to the first plate 116. Each of the first plate 116 and the second plate 118 may include a track 120. The track 120 may be substantially diagonal from a top portion of the plate 116, 118 to a bottom portion of the plate 116, 118 (i.e., may extend both horizontally and vertically). It should be understood that the track 120 may extend only vertically as well. The track 120 is sized and shaped to receive a fastener 16*c* that is associated with the piston rod 16*b*.

Extending at an angle to the track 120 is a plurality of position grooves 122. Each groove 122 is sized and shaped to receive the fastener 16*c* of the piston rod 16*b*. The groove 122 may also include an open end and a closed end. The open end may include a lip 122*a* that aids in preventing the fastener 16*c* of the piston rod 16*b* from backing out of the groove 122 absent an intentional force being applied. Based on a selected position groove 122, the piston rod 16*b* may be pushed further into or pulled out of the resistance element 16.

The fastener 16*c* used to affix and secure the piston rod 16*b* to the upright bracket 100 may include a threaded bolt or pin that extends through an aperture of the piston rod 16*b* and a nut that is affixed to the threaded bolt. The bolt or pin, with the aid of a nut, may be used to secure the piston rod 16*b* to the bracket 100. In addition to the lip 122*a*, the bolt/pin and nut may aid in preventing the bolt/pin from backing out of the groove 122 absent intentional force by the user.

In use, a user selects one of the grooves 122 to seat the fastener 16*c* that is attach the piston rod 16*b*, thereby extending or retracting a desired amount of the piston rod 16*b* from or into the resistance element 16. The desired amount of the piston rod 16 determines a maximum distance by that treadle 12 may travel in the upward direction. Once the user selects a groove 122, the user affixes the piston rod 16 within the selected groove 122 by inserting the bolt through the aperture of the piston rod 16*b*, resting the bolt within the selected groove 122, and securing the nut to the threaded portion of the bolt on an outer surface of the upright bracket 100. Thus, it should be understood that the upright bracket 100 may comprise means for selectively limiting movement of the resistance device or means for selectively adjusting a distance traveled by the treadle assembly in the upward and downward directions during operation of the apparatus.

Figure 5:
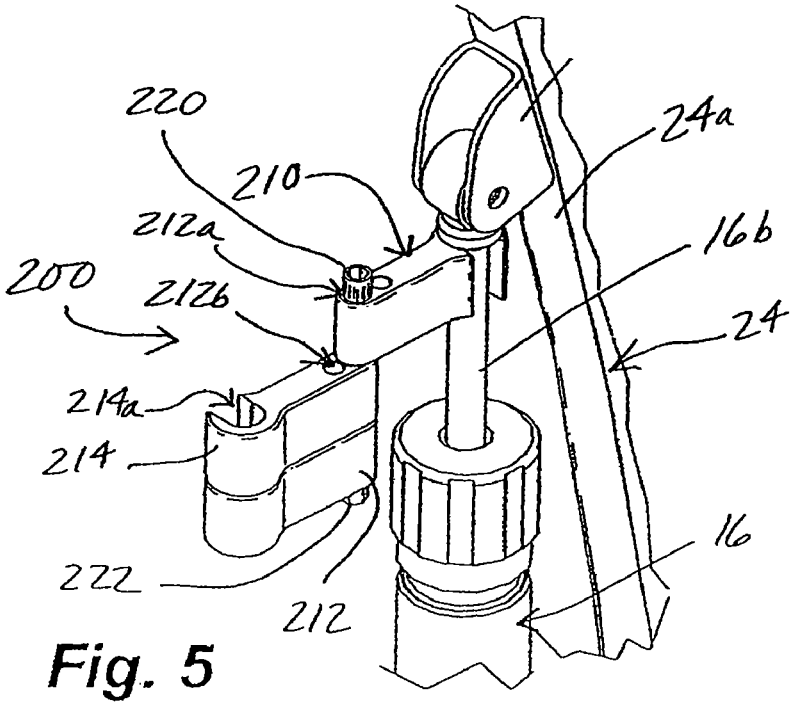
FIG. 5 is a perspective view of another example of a travel-limiting device.
Figure 6:
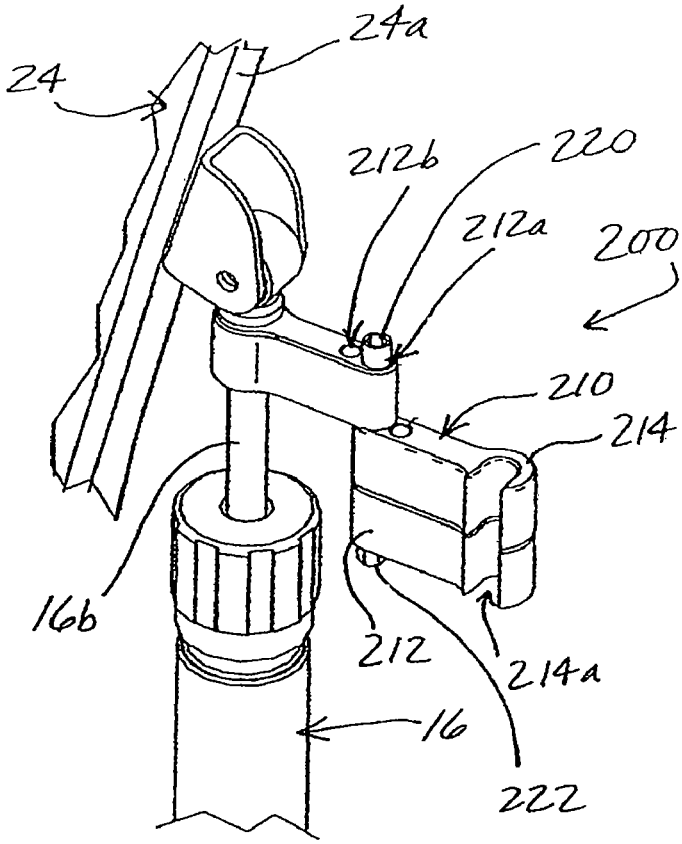
FIG. 6 is another perspective view of the travel-limiting device FIG. 5.
Figure 7:
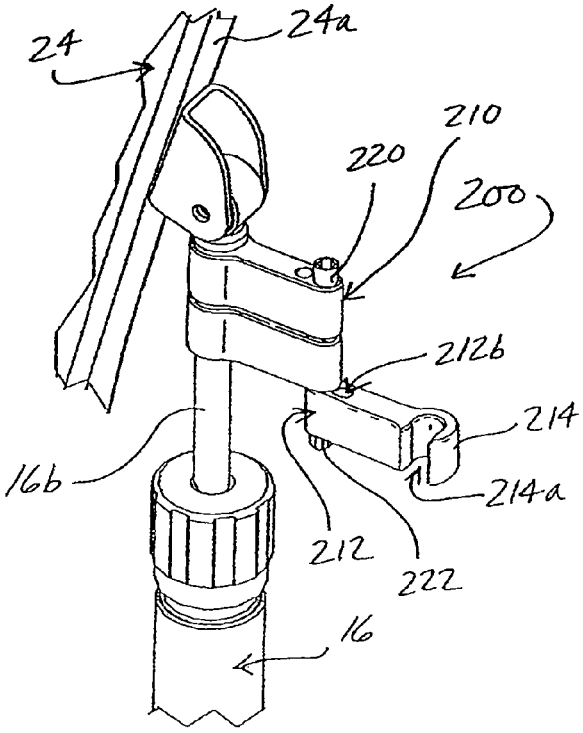
FIG. 7 is a perspective view of the travel-limiting device illustrated in FIG. 5 with two spacers coupled to the piston rod.
Figure 8:
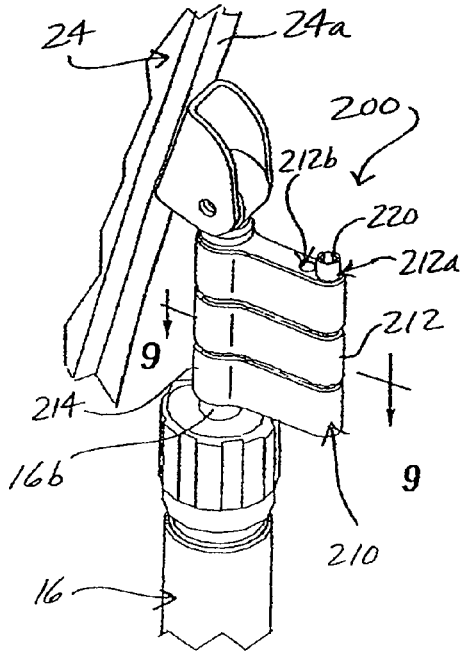
FIG. 8 is a perspective view of the travel-limiting device of FIG. 5 with three spacers coupled to the piston rod.
Figure 9:
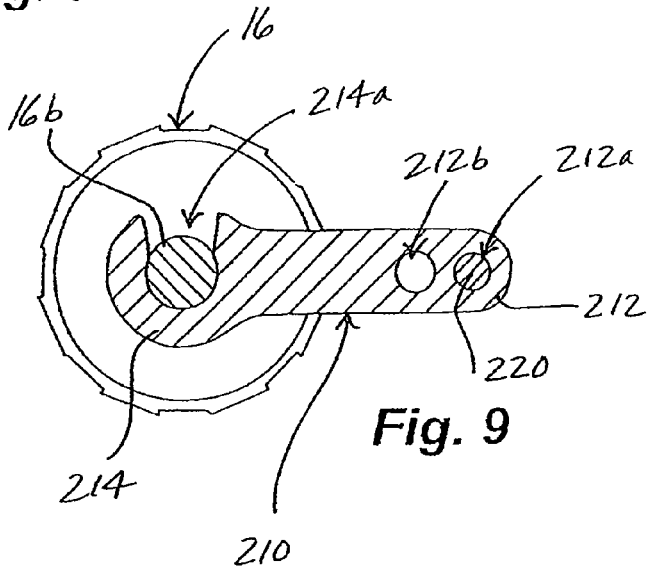
FIG. 9 is a cross-sectional view of the travel-limiting device taken along line 9-9 in FIG. 8.

The following discussion relates to another example of a travel-limiting device/means. FIG. 5 is a perspective view of the travel-limiting device/means as a space-limiting assembly 200 coupled to the piston rod 16*b* of the resistance device 16. FIG. 6 is another perspective view of the space-limiting assembly with one spacer coupled to the piston. FIG. 7 is a perspective view of the space-limiting assembly with two spacers coupled to the piston rod. FIG. 8 is a perspective view of the space-limiting assembly with three spacers coupled to the piston rod. FIG. 9 is a cross-sectional view of the space-limiting assembly taken along the line 9-9 of FIG. 8.

Referring to FIGS. 5-9, the space-limiting assembly 200 limits an amount of the piston rod 16*b* inserted or retracted into the resistance element 16, thereby limiting the distance that the treadle 12 may travel in the upward and downward direction. More particularly, the piston rod 16*b* is affixed to the upright member 24 via an upright bracket 24*b*, and the space-limiting assembly 200 is coupled to the piston rod 16*b* of the resistance element 16, as discussed below.

The space-limiting assembly 200 may include a spacer 210, a plurality of spacers 210 or a device configured to provide a selection of thickness, such as via plural spacers. The spacer 210 may include a coupling end 212 and a rod-connecting end 214. The coupling end 212 may include a first orifice 212*a* and a second orifice 212*b*. The rod-connecting portion 214 may be sized and shaped to contour to the piston rod 16*b* of the resistance element 16. More specifically, the rod-connecting portion 214 of each spacer 210 may include a U-shaped opening 214*a* that grips or otherwise engages on the piston rod 16*b*.

The first orifices 212*a* and the second orifices 212*b* of each spacer 210 of the space-limiting assembly 200 may be aligned. Seated within at least one of the aligned orifices, e.g., the first orifices 212*a*, of each spacer 210 is a threaded bolt 220. A nut 222 with a treaded aperture receives the threaded bolt 220. The bolt 220 couples the spacers 210 of the space-limiting device 200, and the nut 222 secures the spacers 210 along the bolt 220 A pin (not shown) may be seated within the second orifices 212*b* of the spacers coupled to the piston rod 16*b* or not coupled to the piston rod 16*b* to keep the spacers not coupled to the piston rod 16 from interfering with movement of the piston rod 16*b*.

In use, a user couples one or more spacers 210 of the space-limiting assembly 200 to the piston rod 16*b* of the resistance element 16 by attaching the rod-coupling end 214 of at least one of the spacers 210 to the piston rod 16*b*. For example, the user may couple one spacer 210 to the piston rod 16*b*. The coupled spacer 210 may reduce the amount of the piston rod 16*b* that is available for the resistance device 16 to travel. As the treadle 12 travels in the upward direction, only the available portion of the piston rod 16*b* may travel into the resistance element 16, because the spacer 210 coupled to the piston rod 16*b* stops and prevents the remainder of the piston rod 16*b* from being inserted. This in turn reduces the distance that may be traveled by the treadle 12 in the upward direction. Additionally, the user may select multiple spacers or all of the spacers to manipulate the distance that may be traveled by the treadle 12 in the upward direction.

Thus, it should be understood that the spacer(s) 210 may comprise means for selectively limiting movement of the resistance device or means for selectively adjusting a distance traveled by the treadle assembly in the upward and downward directions during operation of the apparatus. It should also be understood that the space-limiting assembly 200 may be coupled to any suitable portion of the exercise device 10, for example, in case none of the spacers 210 are coupled to the piston rod 16*b*. Alternatively, one of the spacers 210 may always be coupled to the piston rod 16*b*.

Figure 10:
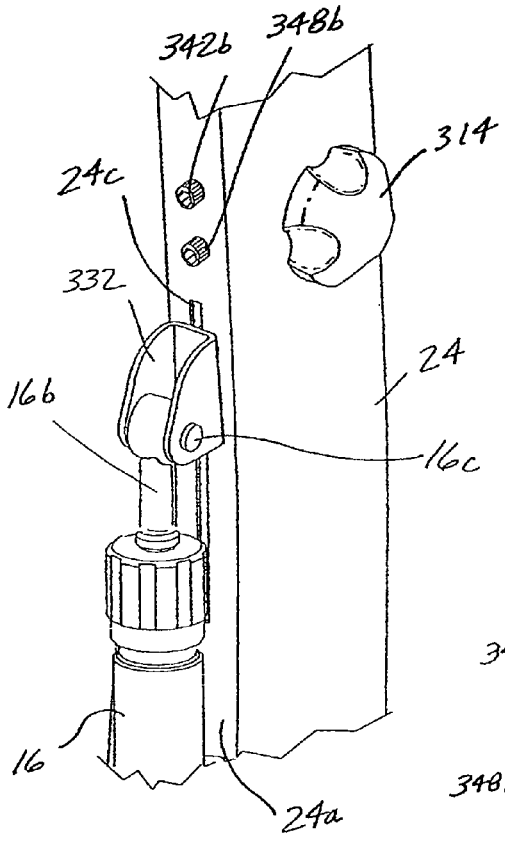
FIG. 10 is a perspective view of another example of the travel-limiting device.
Figure 11:
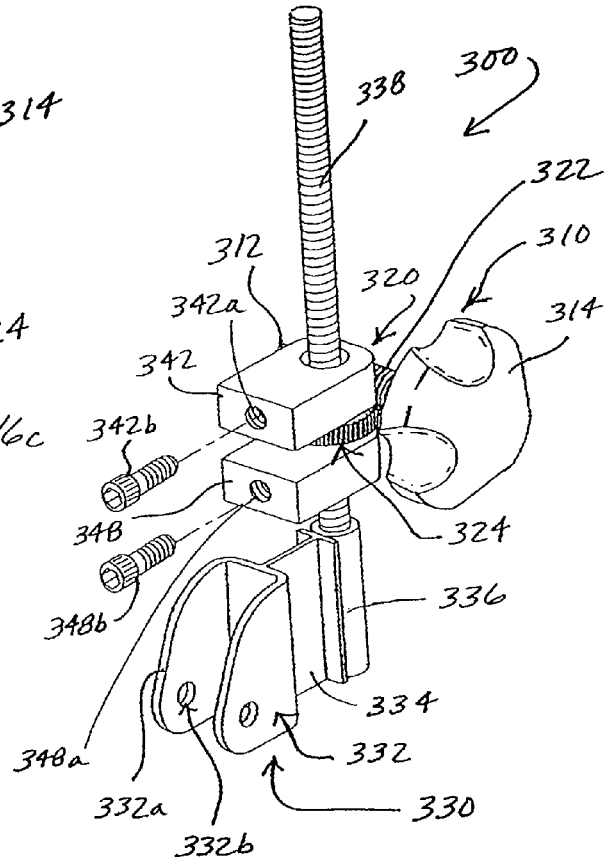
FIG. 11 is a perspective view of a partial exploded view of the travel-limiting device illustrated of FIG. 10, without the upright member and the resistance element.
Figures 12, 13:
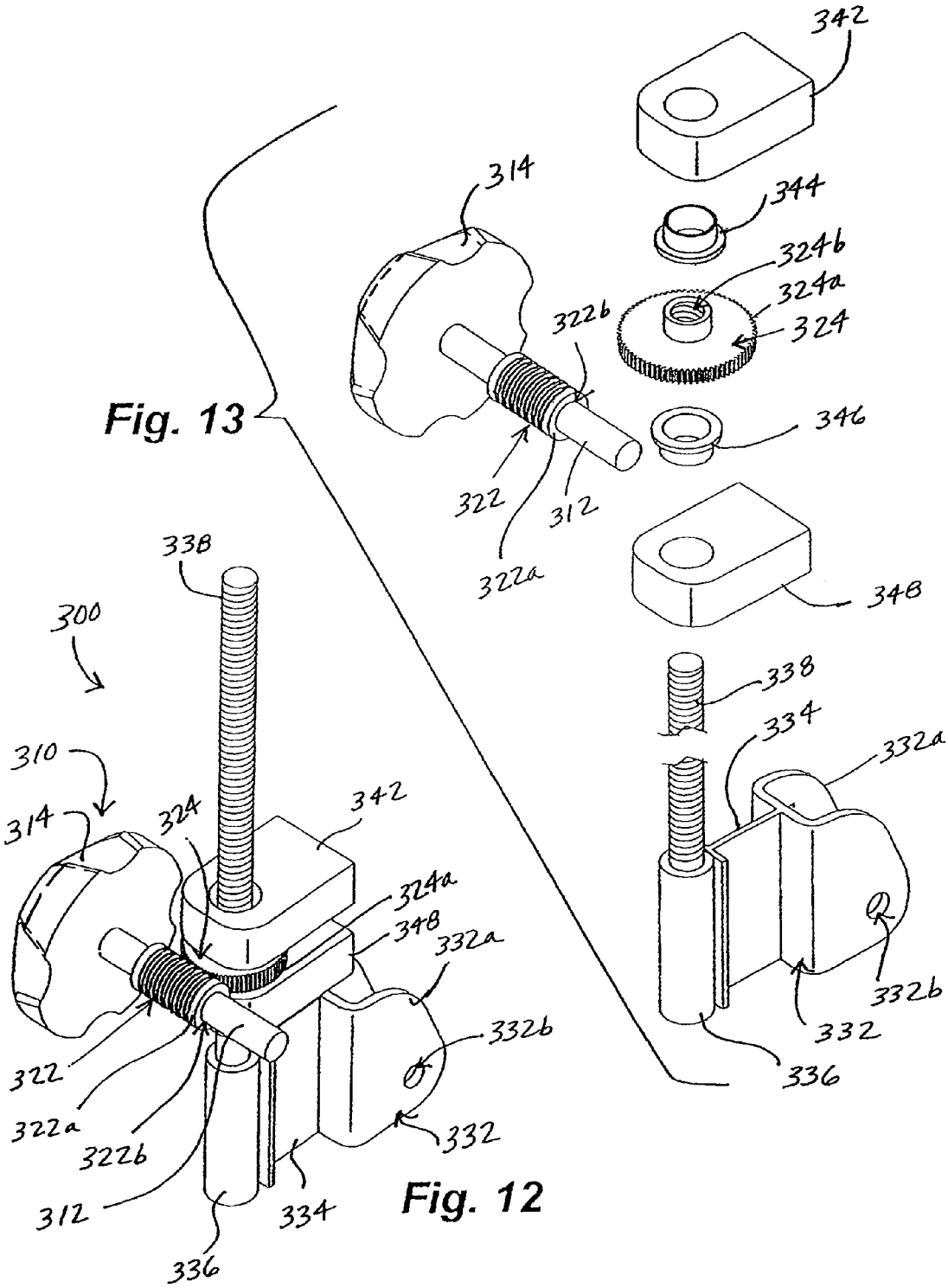
FIG. 12 is a reversed perspective view of the travel-limiting device illustrated of FIG. 11.
FIG. 13 is an exploded view of the travel-limiting device illustrated of FIG. 11.

The following discussion relates to another example of a travel-limiting device/means. FIG. 10 is a perspective view of the travel-limiting device/means as a variable gear adjustment device 300 coupled to the piston rod 16*b* of the resistance element 16 and to the upright member 24. FIG. 11 is a perspective view of the variable gear adjustment device illustrated in FIG. 10 shown without the upright member. FIG. 12 is a backside perspective view of the variable gear adjustment device of FIG. 11. FIG. 13 is an exploded view of the variable gear adjustment device illustrated in FIG. 11.

Referring to FIGS. 10-13, the variable gear adjustment device 300 may include a gear mechanism to adjust the amount of the piston rod 16*b* extended from the resistance element 16, thereby manipulating the distance that the treadle 12 may travel in the upward direction. The variable gear adjustment device 300 resides partially within the upright member 24.

The variable gear adjustment device 300 may include a handle 310, a worm gear assembly 320, and an upright bracket assembly 330. The handle 310 may include a shaft 312 with a knob 314 at one end. With the knob 314 located on the outside of the upright member 24, the shaft 312 extends through a hole in a surface of the upright member 24 and connects to the worm gear assembly 320. The worm gear assembly 320, in turn, connects to the upright bracket assembly 330.

As the handle 310 is turned, the worm gear assembly 320 causes the upright bracket assembly 330 to move within a slot 24*c* of the upright member 24. This causes the upright bracket assembly 330 to move upward or downward to adjust the amount of the piston rod 16*b* that extends from the resistance element 16, which in turn changes the distance available to be traveled by the treadle 12 in the upward direction. For example, if the worm gear assembly 320 lowers the upright bracket assembly 330, the upright bracket assembly 330 pushes the piston rod 16*b* into the resistance element 16 leaving less of the piston rod 16*b* available for travel. On the other hand, if the worm gear assembly 320 raises the upright bracket assembly 330, the upright bracket assembly 330 pulls the piston rod 16*b* out of the resistance element 16 leaving more of the piston rod 16*b* available for travel.

The worm gear assembly 320 may include a first gear 322 with a threaded shaft 322*a* and a wheel gear 324 with teeth 324*a* that mesh into the threaded shaft 322*a*. An axis of the first gear 322 is positioned at a right angle to an axis of the wheel gear 324. The first gear 322 also may include a bore 322*b* that receives the shaft 312 of the handle 310, such that the shaft 312 is secured within the bore 322*b* of the first gear 322 to move therewith.

The upright bracket assembly 330 may include an upright bracket 332, a connecting bracket 334, a bolt 336, and a threaded rod 338. The upright bracket 332 may include a first longitudinal flat wall and a pair of sidewalls 332*a* extending therefrom. The flat wall may include a first or front surface and a second or back surface. The front surface faces outward toward the resistance element 16; the back surface faces inward toward the first surface 24*a* of the upright member 24. Each of the sidewalls 332*a* may include an aperture 332*b* that is sized and shaped to receive the fastener 16*c* that attaches the piston rod 16*b* to the bracket 332.

Coupled to the back surface of the upright bracket 332 is one end of the connecting bracket 334, the other end of the connecting bracket 334 is affixed to the bolt 336. A shaft of the threaded rod 338 extends through a threaded hole of a first bracket 342, a first bushing 344, a threaded bore 324*b* of the wheel gear 324, a second bushing 346, and a threaded hole of a second bracket 348. The threaded rod 338 may be secured in the bolt 336.

The first and second brackets 342, 348 also include a threaded orifice 342*a*, 348*a* to received shafts of threaded fasteners or screws 342*b*, 348*b*. The screws 342*b*, 348*b* extend through apertures in the front surface 24*a* of the upright member 24 and into the threaded orifices. With the screws 342*b*, 348*b* in position, the worm gear assembly 320 is secured to the upright member 24.

In use, for example, a user turns the knob 314 in a first direction causing the first gear 322 to rotate in the clockwise direction. As the first gear 322 rotates, the first gear 322 drives the wheel gear 324 that engages the threaded rod 338 causing the bolt 336 to move in a downward direction toward the ground. As the bolt 336 travels downward, the upright bracket 332 also travels in the downward direction pushing the piston rod 16*b* into the resistance element 16, thereby reducing the distance that the treadle 12 may travel in the upward direction.

When the user turns the knob 314 in a second opposite direction, the first gear 322 also rotates to drive the wheel gear 324. The threaded bore 324*a* of the wheel gear 324 engages the threaded rod 338 causing the bolt 336 to travel in an upward direction away from the ground. As the bolt 336 travels upward, the upright bracket 332 also travels in the upward direction, thereby pulling the piston rod 16*b* out of the resistance element 16 and increasing the distance traveled by the treadle 12 in the upward and down directions. Thus, it should be understood that the movable bracket 332 may comprise means for selectively limiting movement of the resistance device or means for selectively adjusting a distance traveled by the treadle assembly in the upward and downward directions during operation of the apparatus, and that the gear assembly and threaded rod may comprise means for selectively moving the movable bracket.

It should understood that the directions in which the first gear, the wheel gear, and the threaded rod move may depend on the direction of the threading. It should also be understood that the threaded rod may be secured to the wheel gear to turn therewith while being threadedly engaged in the bolt of the bracket assembly.

Figure 14:
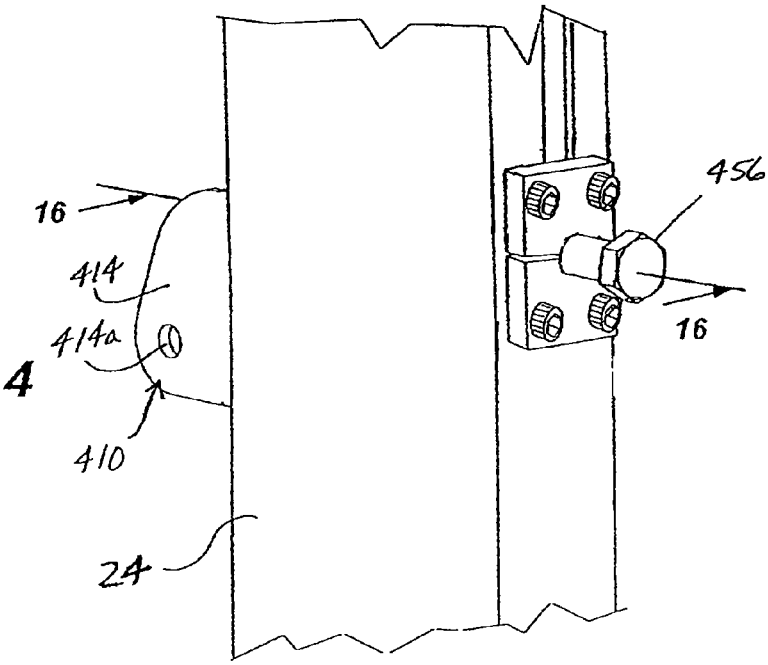
FIG. 14 is a perspective view of another example of a travel-limiting device.
Figure 15:
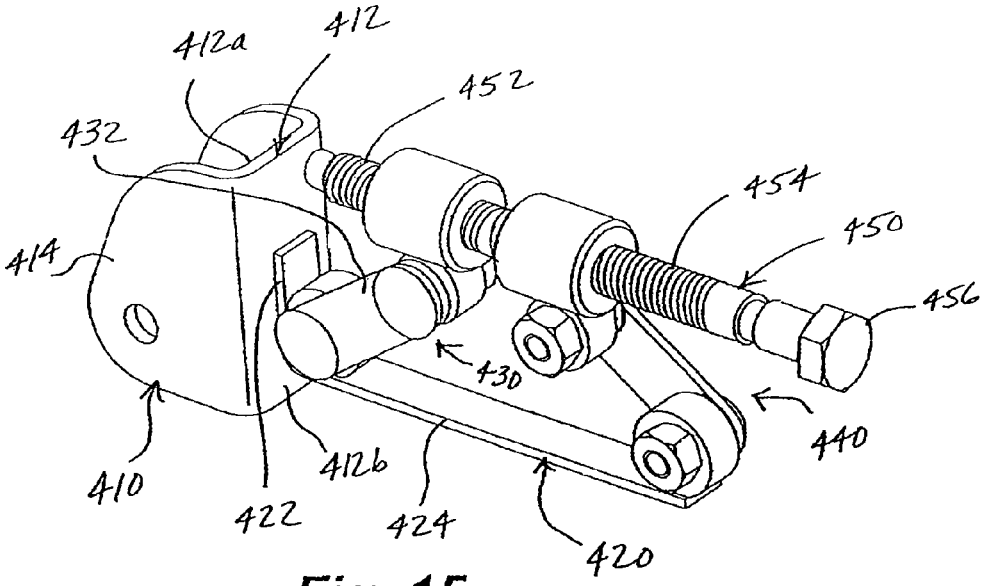
FIG. 15 is a perspective view of the travel-limiting device illustrated of FIG. 14, shown without the upright member of the exercise device.
Figure 16:
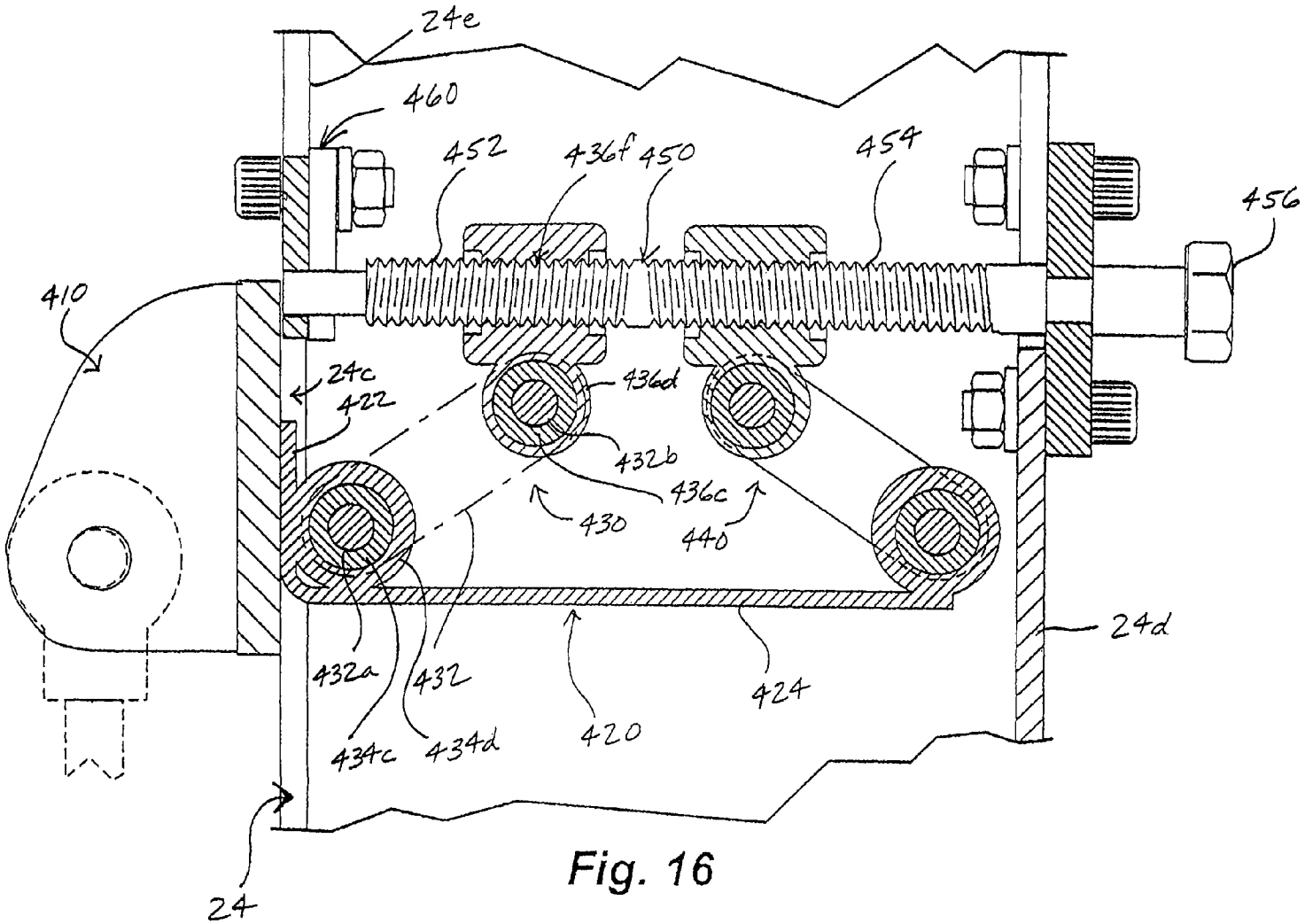
FIG. 16 is a cross-sectional view of the travel-limiting device taken along line 16-16 in FIG. 14.
Figure 17:
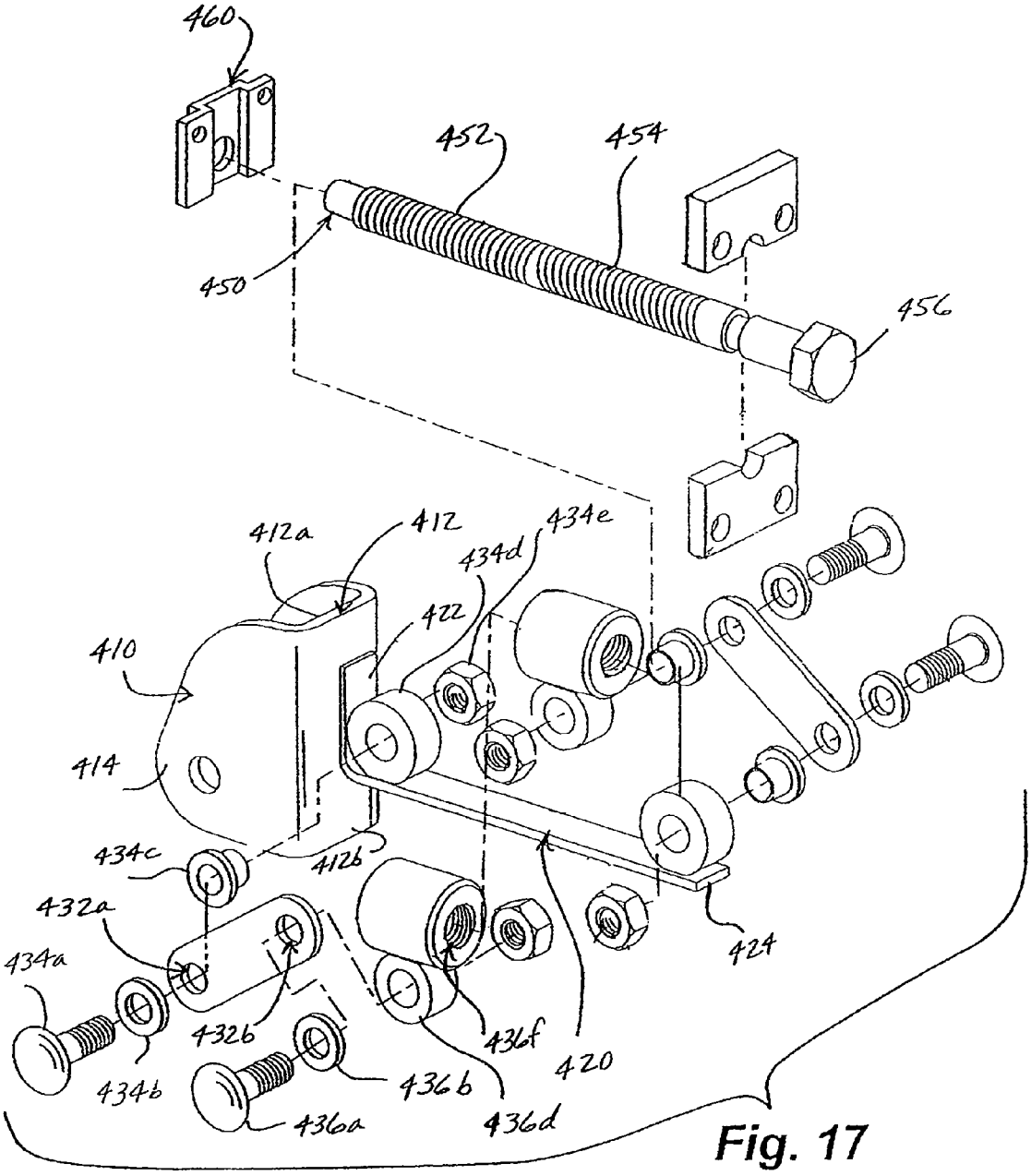
FIG. 17 is an exploded view of the travel-limiting device of FIG. 14.

The following discussion relates to another example of a travel-limiting device/means. FIG. 14 is a perspective view of the travel-limiting device/means as a pivoting adjustment device 400. FIG. 15 is a perspective view of the pivoting adjustment device 400 illustrated in FIG. 14, shown without the upright member. FIG. 16 is a cross sectional view of the pivoting adjustment device 400 taken along line 16-16 of FIG. 14. FIG. 17 is an exploded view of the pivoting adjustment device 400 illustrated in FIG. 15.

As shown in FIGS. 14-17, the pivoting adjustment device 400 may extend or retract the piston rod 16*b* out of or into the resistance element 16, thereby manipulating the distance that the treadle 12 may travel in the upward direction. The pivoting adjustment device 400 may include an upright bracket 410, a L-shaped bracket 420, a first threaded pivot assembly 430, a second threaded pivot assembly 440, and a shaft 450 including first and second threaded portions 452, 454 and a bolt 456.

The upright bracket 410 may include a first longitudinal flat wall 412 and a pair of sidewalls 414 extending therefrom. The flat wall 412 may include a first or front surface 412*a* and a second or back surface 412*b*. The front surface 412*a* faces outward toward the resistance element 16; the back surface 412*b* faces inward toward a surface of the upright member 24. Each of the sidewalls 414 may include an aperture 414*a* that is sized and shaped to receive the threaded bolt 456 for connecting to the piston rod 16*b*.

The L-shaped bracket 420 may include a first portion 422 and a second portion 424. A surface of the first portion 422 is coupled to the second surface 412*b* of the upright bracket 410, and rests within a slot 24*c* of the upright member 24. The first and second pivot assemblies 430, 440 are rigidly connected at opposite ends of the second portion 424 of the L-bracket 420. Welding, gluing, fastening devices or any other suitable approach may accomplish this rigid connection.

The first and second pivot assemblies 430, 440 are mirror images of one another; therefore, only the first pivot assembly 430 will be discussed in detail herein. The first pivot assembly 430 may include a plate or link 432 having a first hole 432*a* located about a first end and a second hole 432*b* located near a second end. A threaded bolt 434*a* extends through a washer 434*b*, the first hole 432*a* of the plate 432, a bushing 434*c*, and a bushing housing 434*d* that is rigidly affixed to one end of the second portion 424 of the L-shaped bracket 420. A nut 434*e* having a threaded aperture receives the threaded bolt 434*a*. This allows the first end of the 432 plate to be secured and pivotally attached to the bushing 434*c* and bushing housing 434*d* such that the plate 432 and the bushing 434*d* may pivot relative to the bushing housing 434*e*.

A second threaded bolt 436*a* extends through a second washer 436*b*, the second hole 432*b* of the plate 432, a second bushing 436*c*, and a second bushing housing 436*d*. A second nut 436*e* having a threaded hole receives the second threaded bolt 436*a*. This allows the second end of the plate 432 to be secured and pivotally attached to the bushing 436*c* and the bushing housing 436*d*, such that the plate 432 and the second bushing 436*c* may pivot relative to the second bushing housing 436*d*. The second bushing housing 436*d* may include a threaded bore 436*f* that is perpendicular to the threaded hole 432*b*. The threaded bore 436*f* is configured to cooperate with and receive the first portion 452 of the threaded shaft 450.

The first and second pivot assemblies 430, 440 are located at opposite ends of the L-shaped bracket 420. More particularly, the first bushing housing 434*d* of the first pivot assembly 430 is affixed to the first end 422 of the L-shaped bracket 420, and the first bushing housing (unnumbered) of the second pivot assembly 430 is affixed to a second end (unnumbered) of the L-shaped bracket 420 near the second portion 422 of the L-shaped bracket 420. The first and second threaded portions 452, 454 of the shaft 450 are positioned in the first and second pivot assemblies 430, 440, respectively, such that their threaded holes 436*f* are threaded in opposite directions of one another.

The bolt 456 of the threaded shaft 450 provides a head at one end and a shank at the other end. The first and second threaded portions 452, 454 that may be threaded in opposite directions. The threaded shaft 450 extends through a hole in a second surface 24*d* of the upright member 24, the threaded bores 436*f* of each second bushing housing 436*d*, and an aperture of a mounting bracket 460. The mounting bracket 460 is affixed to a surface of an interior wall 24*e* of the upright member 24. It secures the shank end of the bolt 456 to the upright 24. This prevents the shank end from freely moving as the treadle 12 is in operation.

In use, for example, a user may turn the bolt 456, in a first direction, to rotate the threaded portions 452, 454 of the shaft 450 in each bushing housing 436*d*. This causes the second bushing housing 436*d* to move toward a center of the shaft 450 (i.e. toward each other). As the second bushing housings 436*d* move toward the center of the shaft 450, the plates 432 pivot in an upward direction causing the L-shaped bracket 420 to move in a generally upward direction. As the L-shaped bracket 420 moves in the upward direction, the upright bracket 410 also moves in the upward direction, which in turn moves the piston rod 16*b* in the upward direction. This set of movements increases the amount of piston rod 16*b* that is extended out of the resistance device 16, thereby increasing the distance available to be traveled by the treadle 12 in the upward direction.

On the other hand, the user may turn the bolt 456, in a second opposite direction, to cause the second bushing housings 436*d* to move away from one another. As the second bushing housings 436*d* move away from one another, the plates 432 pivot and extend in a downward direction toward the ground. This also transitions the L-shaped bracket 420 and the attached upright bracket 410 from a first position to a second position in the downward direction, thereby pushing the piston rod 16*b* down into the resistance element 16. This action reduces the distance available to be traveled by the treadle 12 in the upward direction. Thus, it should be understood that the movable bracket 410 may comprise means for selectively limiting movement of the resistance device or means for selectively adjusting a distance traveled by the treadle assembly in the upward and downward directions during operation of the apparatus, and that the pivoting links 432 may comprise means for selectively moving the movable bracket.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

What is claimed is:

1. An exercise apparatus, comprising; a frame; a treadle assembly operably coupled to the frame to travel in a first direction and a second direction that is opposite the first direction; a resistance device resistively coupling the treadle assembly to the frame and including a piston rod that extends and retracts as the treadle travels in the first direction and the second direction; and a travel-limiting device configured to limit movement of the treadle assembly, the travel-limiting device comprising an element movably associated with the piston rod to limit the retracting of the piston rod;

wherein the resistance device includes a resistive cylinder that the piston rod extends from and retracts into and the travel-limiting device is movably attachable to or detachable from the piston rod to limit the retracting of the piston rod into the resistive cylinder.

2. The exercise apparatus of claim 1, wherein the travel-limiting device includes a spacer.

3. The exercise apparatus of claim 1, wherein the travel-limiting device includes plural spacers movably associated with the piston rod to limit the retracting of the piston rod into the resistive cylinder by plural amounts.

4. The exercise apparatus of claim 3, wherein the plural spacers are pivotally coupled together.

5. The exercise apparatus of claim 1, wherein the travel-limiting device includes plural spacers coupled together and individually movably associated with the piston rod to limit the retracting of the piston rod into the resistive cylinder by plural amounts.

6. The exercise apparatus of claim 1, wherein the resistive cylinder comprises a hydraulic resistive cylinder.

7. The exercise apparatus of claim 1, wherein the frame includes a base and at least one upright extending substantially vertically from the base and the resistance device resistively couples the treadle assembly to the at least one upright.

8. The exercise apparatus of claim 1, wherein the travel-limiting device limits retracting of only one of the first and second piston rods.

9. An exercise apparatus, comprising: a frame including a base and at least one upright extending substantially vertically from the base; a treadle assembly configured to travel in an upward direction and a downward direction; a resistance device resistively coupling the treadle assembly to the frame at a first location and resisting travel of the treadle in the upward and downward directions; a travel-limiting device configured to selectively adjust a distance traveled by the treadle assembly in the upward direction during operation of the exercise apparatus, the travel-limiting device comprising an element movably associated with the resistance device while it is coupled to the frame at the first location;

wherein the resistance device includes a piston rod that extends and retracts as the treadle assembly travels in the downward and upward directions, respectively;

wherein the resistance device includes a resistive cylinder that the piston rod extends from and retracts into and the element of the travel-limiting device is attachable to or detachable from the piston rod to limit the retracting of the piston rod into the resistive cylinder.

10. The exercise apparatus of claim 9, wherein the element includes a spacer.

11. The exercise apparatus of claim 9, wherein the element includes plural spacers movably associated with the piston rod to limit the retracting of the piston rod into the resistive cylinder by plural amounts.

12. The exercise apparatus of claim 11, wherein the plural spacers are pivotally coupled together.

13. The exercise apparatus of claim 9, wherein the element includes plural spacers coupled together and individually movably associated with the piston rod to limit the retracting of the piston rod into the resistive cylinder by plural amounts.

14. The exercise apparatus of claim 9, wherein the resistive cylinder comprises a hydraulic resistive cylinder.

* * * * *